US005953780A

United States Patent [19]

Schollmeyer et al.

[11] Patent Number: 5,953,780

[45] Date of Patent: Sep. 21, 1999

[54] PROCESS AND DEVICE FOR TREATING TEXTILE SUBSTRATES WITH SUPERCRITICAL FLUID

[75] Inventors: Eckhard Schollmeyer, Kempen; Elke Bach, Duisburg; Ernst Cleve, Geldern; Michael Bork, Dortmund; Martin Steinhauer, Herscheid; Jörg-Peter Körner, Hagen, all of Germany

[73] Assignee: Krupp Uhde GmbH, Dortmund, Germany

[21] Appl. No.: 09/051,785

[22] PCT Filed: Jul. 11, 1996

[86] PCT No.: PCT/EP96/03031

§ 371 Date: Apr. 15, 1998

§ 102(e) Date: Apr. 15, 1998

[87] PCT Pub. No.: WO97/14838

PCT Pub. Date: Apr. 24, 1997

[30] Foreign Application Priority Data

Oct. 16, 1995 [DE] Germany ..... 195 38 479

[51] Int. Cl.[6] ..... D06B 23/20

[52] U.S. Cl. ..... 8/158; 68/12.07; 68/18 C; 68/189; 68/207

[58] Field of Search ..... 8/151, 158; 68/18 C, 68/189, 207, 12.07

[56] References Cited

U.S. PATENT DOCUMENTS

| | | | |
|---|---|---|---|
| 2,225,350 | 12/1940 | Rankin | 68/189 |
| 3,751,946 | 8/1973 | Claiborne | 68/12.07 |
| 3,864,947 | 2/1975 | Gray | 68/189 X |
| 4,089,644 | 5/1978 | Carbonell et al. | 68/12.07 X |
| 4,369,035 | 1/1983 | Karrer et al. | 68/207 X |
| 5,250,078 | 10/1993 | Saus et al. | 8/475 |

FOREIGN PATENT DOCUMENTS

| | | | |
|---|---|---|---|
| 0514337 | 11/1992 | European Pat. Off. . | |
| 2229712 | 12/1972 | Germany | 68/189 |
| 2456250 | 8/1976 | Germany | 68/189 |
| 4206956 | 9/1993 | Germany . | |
| 4344021 | 6/1995 | Germany . | |

*Primary Examiner*—Philip R. Coe
*Attorney, Agent, or Firm*—Brown & Wood, LLP

[57] ABSTRACT

The present invention relates to a method of and an apparatus for treating of textile substrates with a supercritical fluid. The textile substrates are formed as spools of yarn or rolled webs, and the supercritical fluid flows over and/or through them substantially perpendicular to their spool or winding axis. At that, the treatment temperature assumes different values during the treatment period. It is provided that during the treatment period, the treatment temperature values are set by at least two functions of the treatment time, and that the supercritical fluid is conditioned differently at the time the following function takes effect.

4 Claims, 1 Drawing Sheet

PROCESS AND DEVICE FOR TREATING TEXTILE SUBSTRATES WITH SUPERCRITICAL FLUID

BACKGROUND OF THE INVENTION

1. Field of the Invention

The present invention relates to a method of and an apparatus for treating of textile substrates with super critical fluid.

2. Description of the Prior Art

Usually, textile substrates such as, e.g., fibers, yarns, fiber heaps, textile fabrics, or wovens, during their finishing, are repeatedly treated in an aqueous system, e.g. are decoted, bleached, colored, washed and the like.

In meantime, in laboratories, processes were developed in which textile substrates are treated with supercritical fluids, in particular, with supercritical carbon dioxide, for different processing purposes. These processes are described in German Publications Nos. 3,904,515, 4,004,111; 3,904,513; 3,906,724; 3,906,737; 3,906,735; 4,200,352; and 4,344,021. These laboratory-developed processes of treating in supercritical fluids require pressures which vary within a range from 30 bar to 600 bar.

With these laboratory processes, textile substrates, as a rule, tissue samples of an order of several square centimeters, are placed in corresponding laboratory autoclaves and are wetted there with a respective supercritical fluid. However, these processes cannot be transferred to all commercial treating processes.

In the commercial treating processes, a textile substrate is converted into a form suitable for an efficient material flow in a textile finishing operation. Yarns are processed in a form of spools of yarn, webs of textile fabric are processed in a form of rolls.

When the finishing step of wound goods includes treating in a supercritical fluid, the goods in a form of spools or rolls are placed in preliminary cleaned autoclaves. Then, the autoclaves are hermetically sealed, filled with a supercritical fluid and are subjected to a suitable treatment pressure between 30 and 400 bar. The supercritical fluid infiltrate the wound goods. Thereby, the most possible uniform treatment results are achieved, i.e., for all parts of the wound goods, e.g., a uniform color intensity in obtained.

However, in comparison with conventional, diffusion-controlled, receding mass transfer processes, a comparatively longer process duration is observed. This longer process durations is a disadvantage in a commercial textile finishing process. Different suggestions for eliminating this disadvantage became known.

German Publication No. 4,206,952 suggests to reciprocate a piston in the autoclaves so that as a result of this movement, the supercritical fluid flows over and/or through the lapped goods. Therefore, the autoclaves should be equipped with pressure vessels with a volume larger than necessary for receiving only the textile goods, as an additional volume for accommodating the piston movement should be provided. This presents a drawback.

German Publication No. 4,206,954 suggests to equip an autoclave with a circulation pump and to subject the wound goods to the over-flow and/or through-flow of the circulating supercritical fluid. In order to achieve uniform results of the treatment, the autoclave is divided in several parallel or separate region subjected to the action of a supercritical fluid. Each region receives a portion of the wound goods. In order to achieve uniform treatment results for all of the portions, each portion is subjected to a complete circulation flow and, finally all portions are simultaneously subjected, side by side, to a portion of a circulating flow.

A drawback is a complex construction of the apparatus and an additional duration of the process associated with treatment of the product with fluid during parallel discharge, which is necessary to achieve uniformity.

German Publication No. 4,206,955 discloses an apparatus for processing in supercritical fluids and an autoclave of which for receiving the textile substrate is associated with at least two pumps. The supercritical fluid is circulated through the autoclave with one pump, with the other pump serving for delivery of a treatment gas which is in a subcritical condition. One pump is designed for a high delivery output to provide for uniform treatment results in textile substrates. Driving two different pumps performing substantially the same task, with the two pumps operating simultaneously only for a short time, is economically not an optimal solution.

German publication No. 4,206,956 discloses an apparatus for treating textile substrates and including at least two autoclaves. The autoclave can be connected with each other to provide for pumping over the treating fluid from one autoclave into another autoclave claded with the treated substrate for the purpose of substrate tapping. Also, circulation of a supercritical fluid through one or several, arranged in a row, autoclaves is contemplated. A drawback consists in that in order to meet to the requirements of a commercial operation of textile finishing, a number of autoclaves and an associated complex conduit system is needed.

In order to create conditions,which are better than existing conditions, for the commercial use of the processes described in the introduction, and particularly those described in publications Nos. 3,904,515; 4,004,111; 3,904,513; 3,906,724; 3,906,737; 3,906,735 and 4,200,352 and which belong to the content of this application, the present invention contemplates the treatment of the textile substrate, with the supercritical fluid at treatment temperatures the values of which are set by a function of the treatment duration.

SUMMARY OF THE INVENTION

The method according to the present invention of treating textile substrates with supercritical fluid, in particular those having the form of spools of yarn or rolled webs, with the supercritical fluid flowing over and/or through them substantially perpendicular to their spool or winding axis, contemplates that the treatment temperatures assume different values during the treatment period.

Different objects can be pursued during treatment of the textile substances with a supercritical fluid. Thus e.g., German Publication No. 3,906,724 describes a process of coloring at which a disperse dye is dissolved in a supercritical fluid, and the obtained dyestuff liquor is applied to the substrate by bringing the liquor and the substrate in contact with each other. This contact takes place in the autoclave in which the liquor is stagnated to the most possible extent. The duration of the treatment for coloring of the tissue specimen is 10 min.

For the coloring of a textile specimen according to the inventive method, the liquor is caused to flow through it. The liquor flows through the textile specimen and leaves the treatment autoclave. Before the liquor is fed into the treatment autoclave, it flows through a mass of pulverized disperse dye in a saturator. Thereby, the liquor, which again flows through a textile specimen, is loaded with the disperse dye to a saturation point.

In the process according to the present invention, during the treatment period in which the liquor is continuously circulated, the treatment temperature, i.e., the temperature of the liquor flowing through the textile specimen assumes different values. The temperature of the circulating liquid can either increase or decrease. To this end, in a heat exchanger, heat is either supplied to the liquor or is taken away. If during the treatment of a textile substrate, the disperse dye is applied, heat is supplied to the liquor, and the treatment temperature assume a higher value. During coloring according to the present invention, preferably, the liquor is heated before being loaded with the disperse dyestuff. To this end, the liquor leaving the autoclave is first flown through the heat exchanger and, finally, through the saturator.

With the used supercritical fluid, in this example, carbon dioxide $CO_2$, with an increased temperature a greater amount of disperse dye can be dissolve. As a result of the liquor circulation according to the present invention, with the liquor being first heated and then loaded with the disperse dye, a textile specimen is impinged with a liquor having a constantly increasing dye concentration. The increasing concentration difference between the dye-absorbing textile substrates and the dye-applying liquor favorably influences the dye diffusion process. The treatment duration is shorter in comparison with isothermal dyes.

Unexpectedly, changing of the treatment temperature according to the present invention influences another process resulting in reduction of the treatment period. Application of the dye is an endothermal process which takes place on the fiber surface. During the treatment of the textile substrate with liquor having an ever increasing temperature within the treatment period, an excess heat becomes available for the acceleration of the endothermal absorption.

The reduction of the duration of treatment with the method according to the present invention is of a big economic significance. The commercial process of textile finishing attaches a great value to a possibility to color of a greatest possible number of yarn spools in the autoclave per working shift. The autoclave is batch-operated. An operational cycle for each batch consists of a plurality of following each other operations, e.g., charging with textile goods, e.g., with spools of yarn, filling with a supercritical fluid until a treatment pressure is reached, treatment with the circulating liquor, bleeding of the supercritical fluid, unloading of the textile goods.

If a conventional mechanized charging device is used, a corresponding time cycle portion of the treatment period is affected. It can be easily seen that duration of coloring of 10 minutes, which was observed in the laboratory, for a textile specimen, cannot be sufficient to meet the economical requirements of a commercial textile finishing.

During the use of the inventive method in a yarn dying shop, conventional crossed spools with a weight of 1,500 g were uniformly colored only for 60 minutes within the treatment period.

At that, the supercritical fluid $CO_2$ flows through the spool from inside out. The substrate layer thickness through which the supercritical fluid flows, is thicker than that of a textile specimen in about one thousand times. The comparatively large reduction of the treatment period in comparison with a stagnated fluid and a constant temperature is obvious.

With conventional wet dyeing processes, the dyed yarn spools are dried in several steps. First, they are predried by hyro-extraction, then they are finally dried in a high frequency drier. These operational steps are not necessary with the process according to the present invention, because the residual $CO_2$ evaporates from the yarn spool without leaving any residue and without adversely affecting the environment.

With the process according to the present invention for treating textile substrates, in particular those formed as spools of yarn or as rolled webs, with a supercritical fluid, with the supercritical fluid flowing over and/or through them substantially perpendicular to their spool or winding axis and with the treatment temperature assuming different values during the duration of treatment, there is contemplated an embodiment with which the different values of the treatment temperature are set by at least one function of the treatment time.

With the discussed coloring of the yarn spools, it was determined that the treatment temperature should increase linearly during the treatment to achieve a uniform dye distribution with a shorter treatment period.

The coefficient of the temperature increase can have a value from 0.5° C./min up to 2° C./min. However, the treatment period cannot be simply shortened by a larger coefficient of the temperature increase, because the limited thermal conductivity of the substrate forms a barrier. If the temperature gradient in the substrate is too steep, the substrate becomes decolorized.

In order to counteract this mechanism, upon passing of a first one third of the treatment period, a smaller coefficient of the temperature increase is used than in the first one third of the treatment period. Thus, the first one third of the treatment period is conducted with a temperature increase of at least 1° C./min and, thereafter, the treatment, up to its very end, is conducted with an increase of 0.5° C./min.

With the process according to the present invention of treating textile substrates, in particular formed as spool of yarn or rolled webs, with a supercritical fluid flowing over and/or through them substantially perpendicular to their spools or winding axis and with the treatment temperature assuming different values during the duration of the treatment, it is contemplated to set the values of the treatment temperature during the treatment period by at least two functions of the treatment duration, and to insure that the supercritical fluid is conditioned differently at the time of the start of the following function.

With this embodiment a particular cost-effective adaptation to actual conditions of a commercial textile finishing process becomes possible. Here, during the performance of the first function of the treatment period, a preliminary treatment of the textile substrate takes place. The preliminary treatment can be directed to removal of grease or to preparation for removal of dirt and wool fat. Such a preliminary treatment may correspond to that described in the German Publication No. 4,004,111, and it can be adapted to the circulation of fluid according to the present invention. At that, $CO_2$ can be used as a cleaning fluid.

The $CO_2$ loaded with the material which was removed from the substrate during the preliminary treatment, can be regenerated in a separator. In the separator, the $CO_2$ is obtained in a subcritical and gaseous form. The charge is extracted and is mechanically separated from $CO_2$. The regenerated $CO_2$ is fed back into the pre-treatment apparatus. The recirculation of $CO_2$ insurers that the preliminary treatment is conducted practically without any loss of the cleaning fluid. Upon the end of the preliminary treatment period, the treatment is further conducted under the condition of the subsequent function. The subsequent function may consist, e.g., in coloring the textile substrate in the remaining treatment period portion, with a linear increase of the temperature from 90° C. to 120° C.

$CO_2$, which was used as a cleaning fluid before, is now used in its regenerated form, i.e., in an unloaded condition, in the following function through in a different condition. The different condition according to the present invention consists in that the supercritical $CO_2$ is loaded with a dye and in this condition is used for coloring. Preferably, the treatment fluid is circulated in a circle in order to keep its condition before each new treatment run at the originally obtained level. During coloring, the dye passes from the supercritical liquor to the colorable textile substrate. Then, the fluid from which the dye was removed, is loaded with a fresh dye.

This, according to the invention, takes place continuously due to a constant contact with a pulverized dye by saturation. Thereby, the original level of the fluid conditioning is permanently retained under the condition of the following function.

The process according to the present invention is used preferably when the treated textile substrate is formed of synthetic fibers, and/or of a mixture of different synthetic fibers, and/or of a mixture of synthetic and natural fibers.

Such synthetic fibers are formed, e.g., of polyester, polyamide, polyamide, polypropelene, or the like. Suitable natural fibers for treatment are silk, cotton, wool, linen and the like.

With the process according to the present invention, different material can be used as a supercritical fluid. Suitable material are, e.g., alcane, in particular, ethane, propane or pentane, ammonia, carbon dioxide, carbon monoxide, dinitrogen monoxide, which can be used separately or in a mixture.

In order to improve the characteristics of a supercritical fluid, e.g., to increase its polarity, additional polar substances can be admixed. Among others, those include water, alcohol and/or salts used as moderators. Preferably, carbon dioxide is used as a supercritical fluid because it is non-combustible and can be released into the atmosphere without any particular safety measures.

According to the present invention, the apparatus for effecting the inventive method of treating a textile substrate includes:

- at least one autoclave for receiving a textile substrate,
- at least one saturator for loading the fluid with active ingredient,
- at least one separator,
- a heat exchanger with associated heating and cooling device,
- a condensator with an associate cooling device and a collector arranged downstream of the condensator,
- a pump.

In the apparatus, the above mentioned devices are so connected with conduits and armature that the fluid, on one hand, can circulate through the dye autoclave, the pump, the heat exchanger, the saturator or, on the other hand, through the dye autoclave, the relief valve, the condensator, the collector, and the pump. According to the invention, it is provided that the process control imparts to the circulation fluid different values of the treatment temperature during the treatment period. The process control is usually effected with a microprocessor. An amplifier unit connects the microprocessor with sensors and actuators which monitor the process parameter or influence them.

A greatest possible automatization of the process becomes possible with the use of the available process control technique. In addition, the available process control technique permits to include the textile finishing operation into the automatized industrial process.

The autoclave itself includes means which provides for the fluid flow through the yarn spool and which provides for flow of fluid from inside into the rolled body through a perforated spool sleeve. If necessary, the autoclave can be so formed that it can receive yarn spool columns and/or a flat product wound on a roller.

The spool columns with flexible sleeves can be preloaded. Seals are placed between sleeve ends of separate spools forming a column. This blocks a short circuit flow of fluid onto the rolls from outside when the column is not preloaded.

The dye autoclave is equipped with a mechanized cover lock. For the autoclaves with an inner diameter of 1 meter, commercial quick-acting clamps for high pressures from 300 bar to 700 bar are available. For larger diameters mechanized segmented annular locks are used. Those are suitable for all treatment pressures which were here considered.

Supercritical fluids are fed with piston and rotary pumps, which are specifically designed for this use. In the process described above, rotary pumps are used when, e.g., a plurality of long spool columns are treated simultaneously.

BRIEF DESCRIPTION OF THE DRAWINGS

The method and the apparatus according to the present invention will now be explained in detail through an embodiment example. For this purpose.

DETAILED DESCRIPTION OF THE PREFERRED EMBODIMENT

Figure 1:
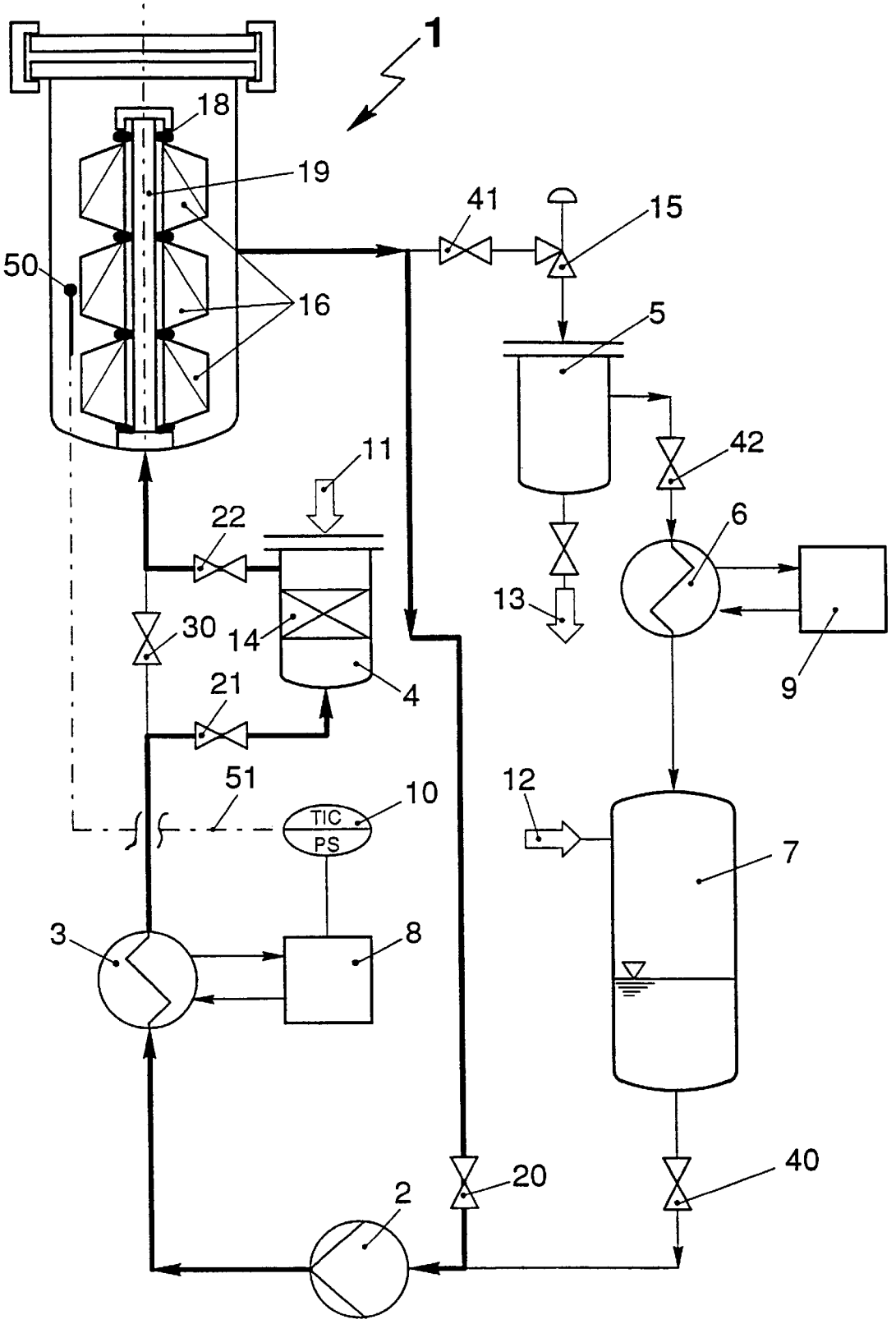
FIG. 1 shows a flow diagram of the process, with the apparatus being formed in accordance with the invention.

With the process according to the present invention, textile substrates such as fibers, yarns, flat-shaped products, shear wool, or the like are treated. They are colored in such a way that the dye is uniformly applied to the textile substrate, and the substrate is uniformly colored. The process can also be conducted in such a way that a preliminary wet cleaning for removing the filament preparation compound, spool oil and other hydrophobic substances, which adversely affect coloring with a supercritical fluid, is eliminated.

The process according to the present invention serves essentially for treating synthetic fibers, their mixture with each other and with natural fibers. For conducting the process supercritical fluid alcanes, in particular, ethane, propane, or pentane, ammonia, carbon dioxide, carbon monoxide, dinitrogen monoxide are used, separately or in a mixture. Water, alcohol and/or salts can be additionally admixed to the supercritical fluid as a moderator for obtaining a polar connection.

The process will be explained through an example of coloring of polyester yarns. For coloring, cross-wound spools of yarns are formed and are loaded in a dye autoclave 1. A dye 11, the weight of which corresponds to about 0.5% of the product weight, is placed into a dye basket 14 of a saturator 4.

For a very active cleaning, which is effected at 280 bar and 120° C., $CO_2$ is fed by a pump 2 from the collector 7 via a heat exchanger 3 into the autoclave 1 and passes through the yarn spools 16 from inside out. At that, the saturator 4 is inactive, it is by-passed with a valve 30. The impurities covering the yarn, such as filament preparators and spool oils, become dissolved in $CO_2$ and are transported via a by-pass valve 41 and a relief valve 15, which is provided for pressure control, to a separator 5. After the pressure reduction, the impurities 13 fall into the separator 5 from gaseous $CO_2$, which is in a subcritical condition, and are collected there. The regenerated $CO_2$ flows back into the collector 7 via valve 42 and a condensator 6. In the collector 7 the regenerated $CO_2$ is mixed with fluid 12.

For effecting coloring, upon conclusion, of the cleaning step, the pump 2 feeds $CO_2$ into dye autoclave 1 via the heat exchanger 3, valve 21, the saturator 4 in which the dye 11 is dissolved in $CO_2$.

The yarn is colored in the autoclave 1 when $CO_2$ is fed with the pump 2 from the autoclave 1 via a closed circuit which includes an overflow valve 20 located upstream of the pump 2, back into the autoclave 1. The coloring is effected at a constant pressure of 280 bar and at ever increasing treatment temperature which linearly increases from 90° C. to 120° C. over the treatment period.

During the treatment period, $CO_2$ is constantly conducted through the saturator 4. Thereby, the $CO_2$ is loaded with the dye 11 at an increasing temperature. The dye 11 enters the $CO_2$ to be dissolved these from the dye basket 14. Because the dye basket 14 contains a greater amount of dye 11 than it is necessary for uniform coloring of yarn spools 16, the $CO_2$ is loaded with the dye 11 until it becomes saturated. After a treatment period of 1 hr, the yarn is uniformly colored and is removed from the autoclave 1. The yarn spools are dried and are ready for shipping.

In FIG. 1, the function of the process control is defined by the process according to invention itself. The process control 10 cooperates with a temperature measuring instrument 50 which measures the actual temperature in the autoclave 1 and which is connected with the control 10 by a lead 51.

At the deviation from a set value, the process control 10 actuates the heating and cooling device 8 and eliminates the deviation. The set values are controlled by the process control 10 in accordance with set/input and stored time functions. Further functions such as pressure control are also automatized with pressure control 10, however, they are not shown in FIG. 1 for better clarity.

We claim:

1. An apparatus for treating a textile substrate with a supercritical fluid, comprising:

at least one autoclave for receiving the textile substrate;

at least one saturator for loading the fluid with an active ingredient;

at least one separator;

a relief valve arranged upstream of the at least one separator;

a heat exchanger with an associated heating-cooling device;

a condensator with an associated cooling device;

a collector arranged downstream of the condensator;

a pump;

first closed conduit means for communicating an outlet of the autoclave with an inlet of the autoclave and including a first section communicating the autoclave directly with the pump, a second section communicating the pump with the heat exchanger, and a third section communicating the heat exchanger with the autoclave, the third section having a first branch communicating the heat exchanger directly with the autoclave, a second branch communicating the heat exchanger with the saturator, and a third branch communicating the saturator with the autoclave;

first valve means for controlling flow of fluid through the first, second and third sections of the first conduit means:

second conduit means for communicating the autoclave with the pump and including a first section communicating the autoclave with the relief valve, a second section communicating the relief valve with the separator, a third section communicating the separator with the condensator, a fourth section communicating the condensator with collector, and a fifth section communicating the collector with the pump;

second valve means for controlling flow of fluid through the second conduit means;

means for measuring temperatures in the autoclave; and control means for controlling operation of the heat exchanger in accordance with a temperature measured by the measuring means in accordance with set/input and stored time functions.

2. A method of treating at least one of yarn spools and rolled webs with a supercritical fluid which flows at least one of over the at least one of the rolled webs and yarn spools and through the at least one of the rolled webs substantially perpendicular to a winding axis of the at least one of the yarn spools and rolled webs, the method comprising the steps of:

placing the at least one of yarn spools and the rolled webs into an autoclave;

circulating the supercritical fluid through the autoclave;

constantly saturating the circulated supercritical fluid with a dye; and increasing or decreasing a temperature of the circulating supercritical fluid dependent on thermal conditions in the autoclave.

3. A method according to claim 2, wherein the temperature increasing or decreasing step includes changing the temperature as a function of a treatment period.

4. A method according to claim 2, including the step of conditioning the supercritical fluid in accordance with a function to be performed by the supercritical fluid.

* * * * *